US010002736B2

(12) United States Patent
Woodson

(10) Patent No.: US 10,002,736 B2
(45) Date of Patent: Jun. 19, 2018

(54) DOUBLE MAKE DOUBLE BREAK INTERRUPTER MODULE WITH INDEPENDENT BLADES

(71) Applicant: SCHNEIDER ELECTRIC USA, INC., Schaumburg, IL (US)

(72) Inventor: Cameron L. Woodson, Cedar Rapids, IA (US)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 0 days. days.

(21) Appl. No.: 15/033,297

(22) PCT Filed: Dec. 5, 2013

(86) PCT No.: PCT/US2013/073274
§ 371 (c)(1),
(2) Date: Apr. 29, 2016

(87) PCT Pub. No.: WO2015/084362
PCT Pub. Date: Jun. 11, 2015

(65) Prior Publication Data

US 2016/0268087 A1 Sep. 15, 2016

(51) Int. Cl.
*H01H 1/22* (2006.01)
*H01H 71/10* (2006.01)
(Continued)

(52) U.S. Cl.
CPC ..... *H01H 71/10* (2013.01); *H01H 1/205* (2013.01); *H01H 1/2041* (2013.01); *H01H 1/50* (2013.01);
(Continued)

(58) Field of Classification Search
CPC .... H01H 71/10; H01H 1/2041; H01H 73/045; H01H 2235/01; H01H 2205/002; H01H 1/2058
(Continued)

(56) References Cited

U.S. PATENT DOCUMENTS 2,765,377 A 10/1956 Buchmann
3,218,428 A * 11/1965 Gauthier ..... H01H 1/226 200/244
(Continued)

FOREIGN PATENT DOCUMENTS

CN 1758404 4/2006
DE 102006004401 4/2007

OTHER PUBLICATIONS

International Search Report and Written Opinion dated Apr. 21, 2014 in PCT/US2013/073274, 12pp.
(Continued)

*Primary Examiner* — Edwin A. Leon
*Assistant Examiner* — Lheiren Mae A Caroc
(74) *Attorney, Agent, or Firm* — Locke Lord LLP

(57) ABSTRACT

An interrupter module (10) of a molded case circuit breaker (2) includes two stationary electrical contacts (20), and a blade carrier assembly (100) with a blade assembly (130) and a carrier (160) for the blade assembly. The blade assembly includes two conductive blades (140A, 140B). Each blade includes a movable electrical contact (150A, 150B) for engaging a corresponding stationary electrical contact in a closed position and for disengaging from the corresponding stationary electrical contact in an open position. Each blade has an independent over travel and contact force to maintain contact between the movable electrical contacts and corresponding stationary electrical contacts in the closed position.

10 Claims, 7 Drawing Sheets

(51) Int. Cl.

| | |
|---|---|
| ***H01H 1/20*** | (2006.01) |
| ***H01H 73/04*** | (2006.01) |
| ***H01H 1/50*** | (2006.01) |
| *H01H 77/10* | (2006.01) |

(52) U.S. Cl.
CPC ..... *H01H 73/045* (2013.01); *H01H 1/2058* (2013.01); *H01H 77/104* (2013.01); *H01H 2205/002* (2013.01); *H01H 2235/01* (2013.01)

(58) Field of Classification Search
USPC ..... 200/244, 243, 248, 400
See application file for complete search history.

(56) References Cited

U.S. PATENT DOCUMENTS

| | | | | |
|---|---|---|---|---|
| 5,899,323 | A * | 5/1999 | Rakus | H01H 1/226 200/244 |
| 6,114,641 | A | 9/2000 | Castonguay et al. | |
| 6,403,901 | B1 | 6/2002 | Boeder et al. | |
| 7,948,336 | B2 | 5/2011 | Park | |
| 8,039,770 | B2 | 10/2011 | Schaltenbrand et al. | |
| 8,350,168 | B2 | 1/2013 | Faik | |
| 9,136,067 | B2 * | 9/2015 | Bausch | H01H 1/205 |
| 2003/0038695 | A1 | 2/2003 | Kramer | |
| 2005/0046539 | A1 | 3/2005 | Ciarcia et al. | |
| 2007/0215577 | A1 | 9/2007 | Park | |
| 2010/0032269 | A1 | 2/2010 | Schaltenbrand et al. | |
| 2010/0044196 | A1 | 2/2010 | Dahl et al. | |
| 2013/0048484 | A1 | 2/2013 | Bausch et al. | |

OTHER PUBLICATIONS

Extended European Search Report for Application No. 13898692.2-1808 / 3078042 PCT/US2013073274 dated Jul. 14, 2017.

CN 1st Office Action for CN Application No. 201380080961.1—dated May 26, 2017.

* cited by examiner

DOUBLE MAKE DOUBLE BREAK INTERRUPTER MODULE WITH INDEPENDENT BLADES

FIELD

The present disclosure relates generally to the field of molded case circuit breakers (MCCBs), and more particularly, to a rotatable blade assembly with two conductive blades each having an independent over travel and contact force.

BACKGROUND

A circuit breaker is an overcurrent protective device that is used for circuit protection and isolation. The circuit breaker provides electrical system protection when a designated electrical abnormality such as an overcurrent event occurs in the system. One type of circuit breaker is a molded case circuit breaker (MCCB), which includes a case containing multiple circuit interrupters of a modular type for multiple poles, commonly for different phases of a three phase electrical system. Typically, the circuit breaker has 3 or 4 poles coupled together with common drive pins.

The circuit interrupt modules are connected by the drive pins to a common drive mechanism for allowing the movable electrical contacts to engage or separate from corresponding stationary electrical contacts in the circuit breaker. The movable electrical contacts are carried on a unitary arm or blade contained on a rotating blade carrier in each module. The common drive pins extend through each of the blade carriers of the separate modules. A common drive mechanism imparts a rotation on the drive pins which in turn rotates the blade carriers to open or close the circuit of all of the poles.

Over time, the operation of the circuit breaker may result in uneven wear of the electrical contacts. For example, after a first occurrence of a short circuit, the electrical contacts associated with either side of the unitary arm or blade of the circuit breaker may begin to erode as a result of arcing from the short circuit which impacts each electrical contact to a different degree. The electrical contacts on one side will tend to have greater erosion than the electrical contacts on the other side. Once the first short circuit begins to unevenly erode the electrical contacts, the side with the greater erosion will likely continue to erode at a faster rate from subsequent short circuits. As a result, the side with the more eroded electrical contacts will have a lower contact force or a diminished or unavailable over travel (also referred to as "overtravel") range between the movable and stationary electrical contacts when the circuit breaker is in the closed position, even though the less eroded contacts on the other side are still able to establish an electrical connection. The terms "overtravel" and "over travel" as used herein relate to a distance that a movable electrical contact is able to move past an initial contact position between the movable electrical contact and the stationary electrical contact, or a contact force (or magnitude of the force) corresponding to the over travel distance.

SUMMARY

To address these and other shortcomings, an interrupter module of a molded case circuit breaker (MCCB) is disclosed. The interrupter module includes two stationary electrical contacts and a rotatable blade carrier assembly with a blade assembly housed in a rotatable carrier (or "blade carrier"). The blade assembly includes two conductive blades, each of which has a movable electrical contact configured to engage a corresponding one of the stationary electrical contacts in a closed position and to disengage from the corresponding one of the stationary electrical contacts in an open position. Each of the two conductive blades has an independent over travel and contact force to maintain their movable electrical contacts in contact with corresponding stationary electrical contacts in the closed position.

The disclosed interrupter module addresses the problems with uneven erosion of the electrical contacts by using two conductive blades, rather than a single piece or unitary blade. For example, each conductive blade has associated therewith an extension spring(s), which has one end connected to a pivot pin on the conductive blade and an opposite end connected to a fixed pin on the carrier. The extension spring of each of the conductive blades is used to control the over travel and contact force of the conductive blade. Therefore, the over travel range of each of the two conductive blades and their movable electrical contacts can be individually controlled to ensure proper engagement of each movable electrical contact with a corresponding stationary electrical contact in the closed position and to reduce a magnitude, rate and impact of uneven erosion of the electrical contacts resulting from short circuits over time.

The disclosed interrupter module may also provide for controlled contact force through the use of cam surfaces (e.g., profiled surfaces) on the carrier, when the interrupter module employs blow-out contacts, in addition to a trip mechanism. For example, the two conductive blades of the blade assembly are rotatably mounted in the carrier such that the pivot pin of each conductive blade cams against a corresponding one of the cam surfaces of the carrier to control movement of the conductive blades between the closed position and an initial open position, i.e., a blown open position, and between the blown open position and a final open position, i.e., a normal open or tripped position. The cam surfaces allow consistent extension spring length through the entire over travel range for each conductive blade of the blade assembly.

BRIEF DESCRIPTION OF THE DRAWINGS

The description of the various exemplary embodiments is explained in conjunction with the appended drawings, in which.

DETAILED DESCRIPTION

By way of general discussion, a molded case circuit breaker of the type discussed herein generally has a base with interior compartments for containing the multiple interrupter modules and the operating mechanism module which drives the interrupter modules by common drive pins as discussed below. A cover or covers are coupled to the base over the interrupter modules. The handle of the circuit breaker is attached to the operating mechanism and extends through the cover to give the operator the ability to turn the circuit breaker ON to energize a protected circuit or OFF to disconnect the protected circuit, or to reset the circuit breaker after it trips to protect the circuit. A plurality of line-side contact and load-side straps will extend through the case for connecting the circuit breaker to the intended electrical conductors. A general description and illustration of these known parts of the circuit breaker as a whole can be found in U.S. Pat. No. 6,965,292 for the edification of the reader should such be needed, but will not be further discussed herein.

Figure 1:
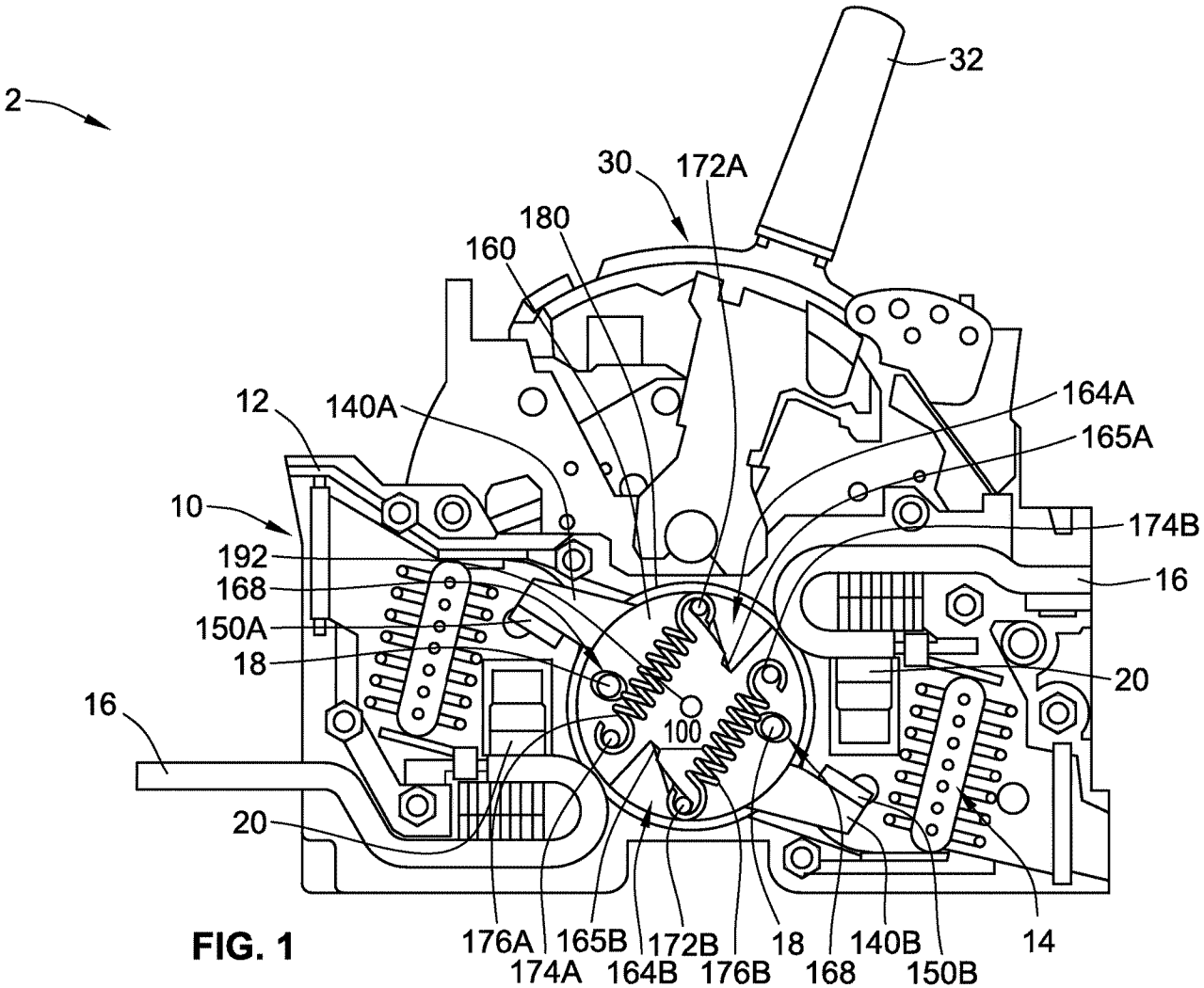
FIG. 1 illustrates a side view of a circuit breaker and one of its interrupter module with one side removed to show the internal parts in an open position or OFF state, in accordance with an exemplary embodiment of the present disclosure.

FIG. 1 shows a side view of a molded case circuit breaker 2 with one side of its case and its movable blade carrier assembly cover removed to show the exemplary parts. The circuit breaker 2 includes one or more interrupter module(s) 10 (also referred to as an "ampoule assembly"), which can be operated to turn the circuit breaker ON or OFF or to reset the circuit breaker 2, via a handle 32 connected to an operating mechanism 30. Typically, a molded case circuit breaker has three or four interrupter modules, sometimes called poles, coupled together with drive pins, such as drive pins 18 of the operating mechanism 30.

Each interrupter module 10 includes arc chutes 14 and line and load side lugs collectively 16. An interrupter case (or casing) 12 may be a plastic casing that holds the operable components of the interrupter module 10 together, and may be formed of two side casings which are screwed, riveted, or otherwise fastened together. The circuit breaker trip mechanism (not shown) imparts a rotation on the drive pins 18, passing through the rotatable blade carrier assembly 100, which in turn rotate the blade carrier assembly 100 to move two conductive blades 140A and 140B to disengage (e.g., disconnect) respective movable electrical contacts 150A and 150B from corresponding stationary electrical contacts 20, thereby interrupting or opening the electrical path in which the interrupter module 10 is connected. As will be described in further detail herein, each of the conductive blades 140A and 140B has an independent over travel and contact force to maintain or keep their movable electrical contacts 150A and 150B engaged to corresponding stationary contacts 20 in the closed position. The blade carrier assembly 100 of the interrupter module 10 also includes a cover 180 with two opposing circular sides (only one side shown in FIG. 1), which may help to control friction between the blade carrier assembly 100 and the sides of the interrupter module 10.

In addition to the tripping mechanism, the movable electrical contacts 150A and 150B and the stationary electrical contacts 20 of the circuit breaker 2 may be blow-out (or blow-apart) contacts, which are designed to separate or be forced apart as a result of a sufficiently strong magnetic field generated by current in excess of a fault current level or threshold (e.g., a fault current), such as when a short circuit occurs. For example, under normal operating conditions, the operating current does not generate sufficient magnetic force to separate or disengage the movable electrical contacts from the stationary contacts in the closed position. However, when the current exceeds the fault current level or threshold, the resulting magnetic force, which is proportional to the current, causes the movable electrical contacts to disengage from the stationary electrical contacts (e.g., blow out or blow apart). At the same time, the trip mechanism of the circuit breaker is tripped as a result of the fault current (e.g., a magnetic field surrounding a current carrying conductor near the trip mechanism provides sufficient force to unlatch the trip mechanism and trip the circuit breaker). Accordingly, the combination of magnetic fields forcing the electrical contacts apart while simultaneously tripping the circuit breaker results in rapid interruption of the fault current.

Figure 4:
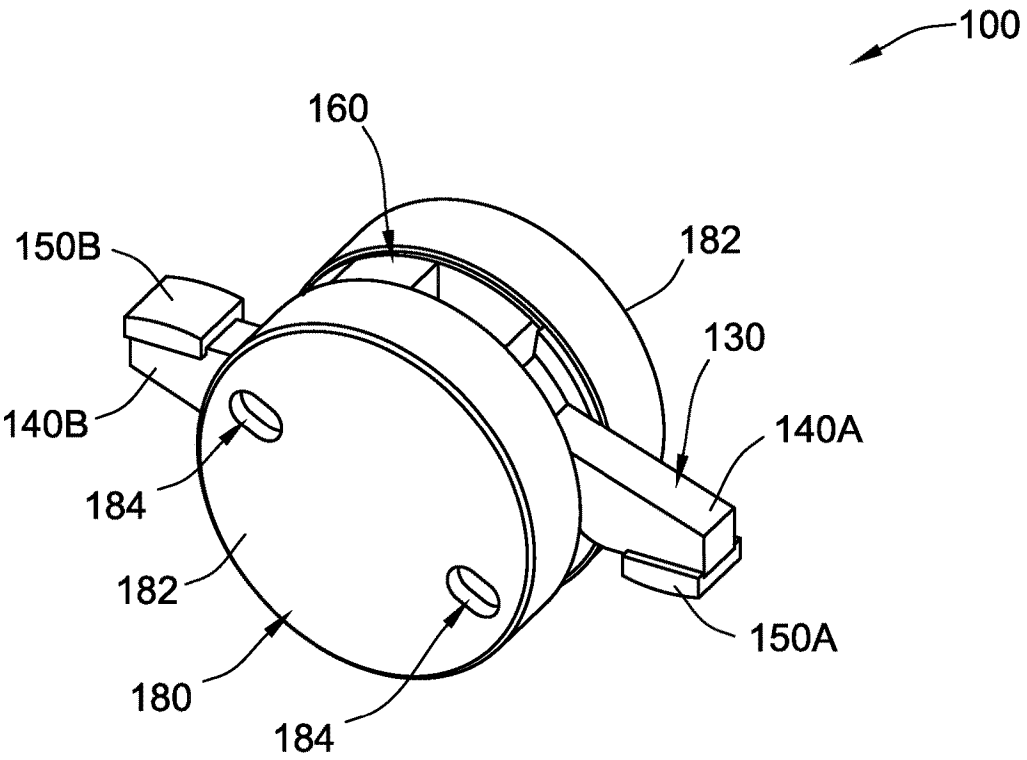
FIG. 4 illustrates a blade carrier assembly of the interrupter module of the circuit breaker of FIG. 1.
Figure 5:
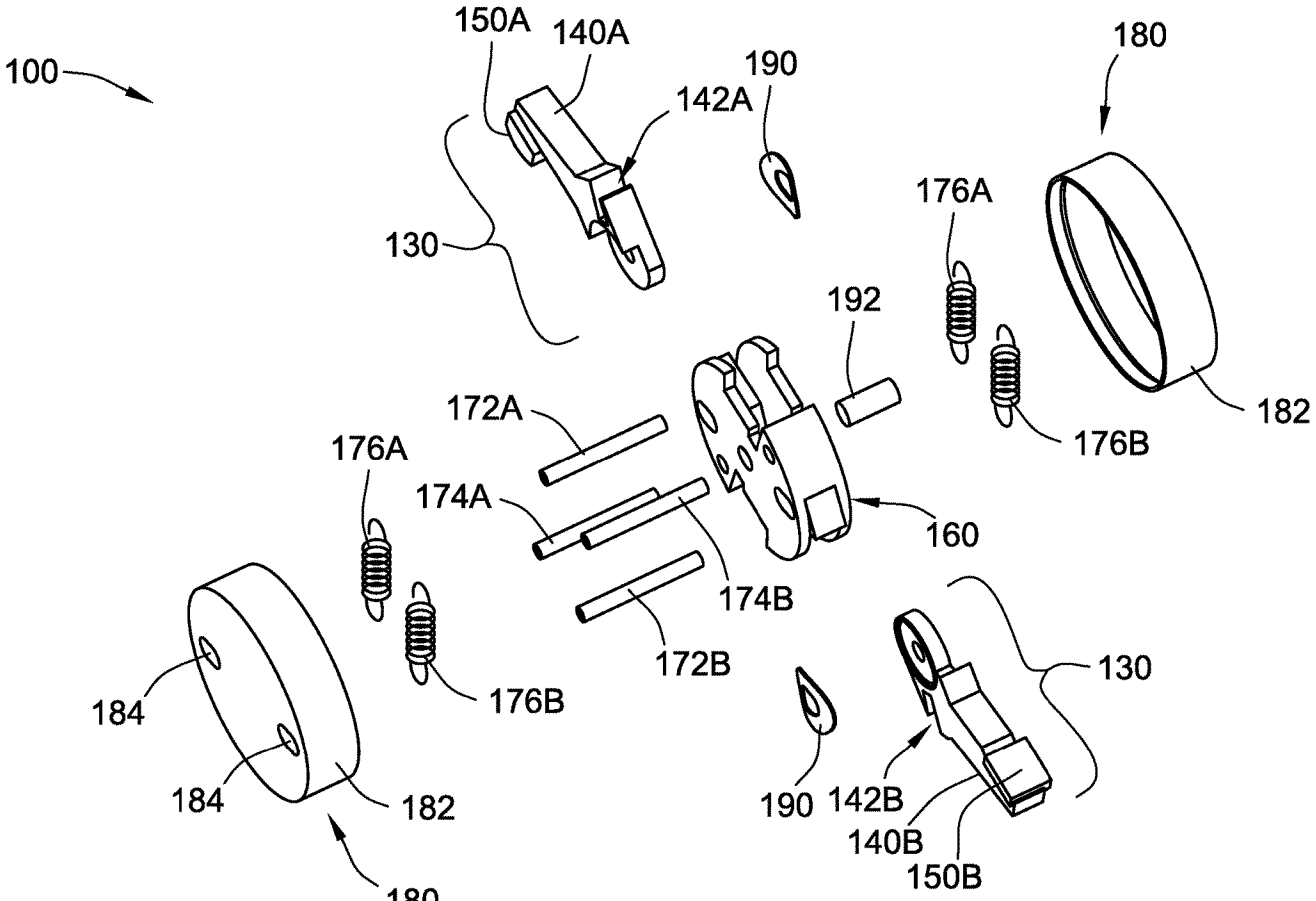
FIG. 5 illustrates an exploded view of the components of the blade carrier assembly of FIG. 4.
Figure 6:
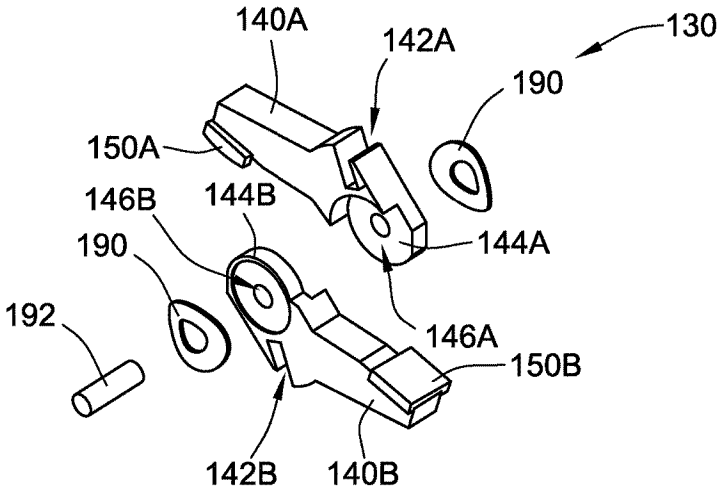

FIG. 4 shows the blade carrier assembly 100 of FIG. 1 with both circular sides (collectively 182) of the cover 180. Each of the circular sides 182 of the cover 180 includes two spaced-apart openings 184 for receiving a portion of one of the two drive pins (e.g., the drive pins 18 in FIG. 1). FIG. 5 illustrates an exploded view of the components of the blade carrier assembly 100 of the interrupter module 10. As shown in FIG. 5, the blade carrier assembly 100 includes a blade assembly 130, which includes the conductive blade 140A with the movable electrical contact 150A, the conductive blade 140B with the movable electrical contact 150B, two wave washers 190 and a shaft (or pin) 192. The conductive blade 140A includes an angled groove 142A and an end portion 144A with a hole 146A. The groove 142A is configured to house or retain a pivot pin 172A. The conductive blade 140B also includes an angled groove 142B and an end portion 144B with a hole 146B. The groove 142B is configured to house or retain a pivot pin 172B. FIG. 6 shows another exploded view of the components of the blade assembly 130.

Figure 7:
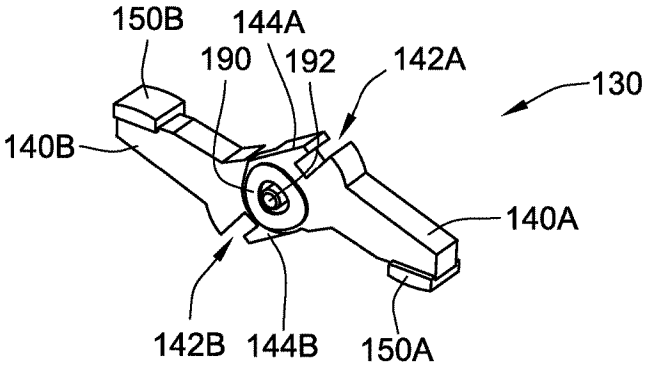
FIGS. 6 and 7 illustrate an exploded view and an assembled view, respectively, of a blade assembly of the movable blade carrier assembly of FIG. 5.

As shown in FIG. 7, the conductive blades 140A and 140B of the blade assembly 130 are pivotally connected together at their end portions 144A and 144B, via the shaft 192 which extends through the holes 146A and 146B. Each side of the blade assembly 130 includes one of the wave washers 190. The end portions 144A and 144B, when engaged, includes a gap 148 that provides a range of pivotal movement by the conductive blades 140A and 140B in relation to each other. In this example, the end portion 144A of the conductive blade 140A is designed with a recessed portion to receive the end portion 144B of the conductive blade 140B. The dimension of the gap and the range of pivotal movement can be configured according to the dimension of the end portions when pivotally engaged via the shaft 192. The components of the blade assembly 130 are formed of a conductive material to allow current to flow from one of the movable contacts 150A and 150B to the other of the movable contacts 150A and 150B. Other blade assembly configurations, including fastening mechanisms, may be employed to pivotally connect two conductive blades together to provide a range of pivotal movement therebetween.

Turning back to FIG. 5, in addition to the blade assembly 130, the blade carrier assembly 100 also includes a cylindrical carrier 160 for housing the blade assembly 130, pivot pins 172A and 172B, fixed pins 174A and 174B, a pair of extension springs 176A and a pair of extension springs 176B. All of the components are housed in the cover 180. In this example, the cover 180 is formed of two circular sides 182, which can be engaged and fastened together while allowing a portion of each of the conductive blades 140A and 140B and their movable electrical contacts 150A and 150B to extend therethrough (as shown in FIG. 4). The two circular sides of the cover 180 can be fastened together using any suitable fastening mechanism (e.g., snap fit assembly, bolt or screw assembly, cantilever and slot, tongue and groove, etc.).

Figure 9:
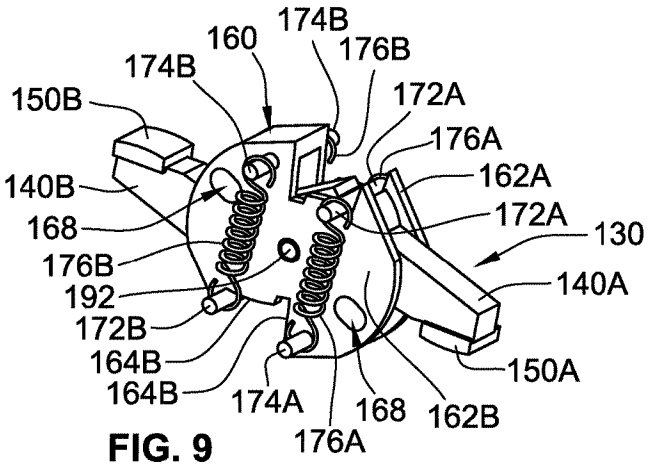
FIGS. 8 and 9 illustrate the blade assembly of FIGS. 6 and 7 rotatably housed in carrier of the blade carrier assembly of FIG. 5, shown without and with pins and springs assembled thereon, respectively.
Figure 8:
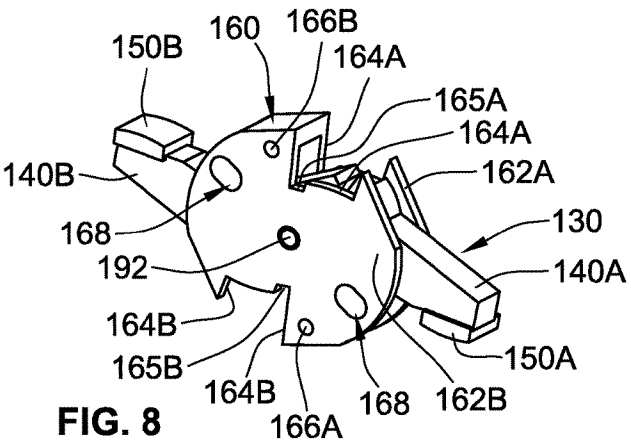
Figure 10:
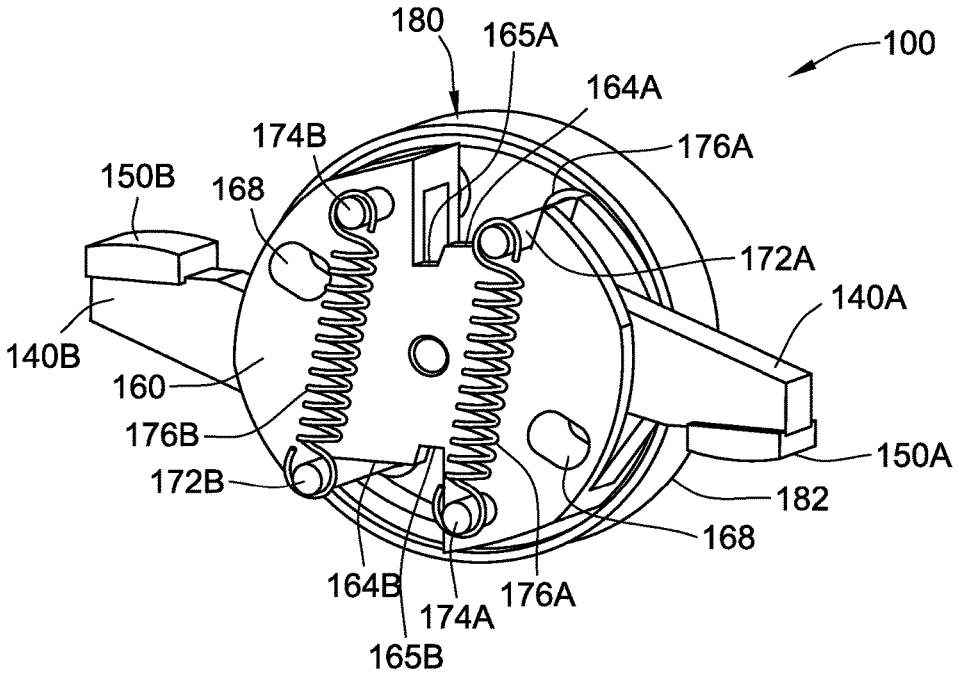
FIG. 10 illustrates an enlarged side view of the blade carrier assembly of FIGS. 1 and 2 with one side of the cover removed to show the internal parts.
Figure 11:
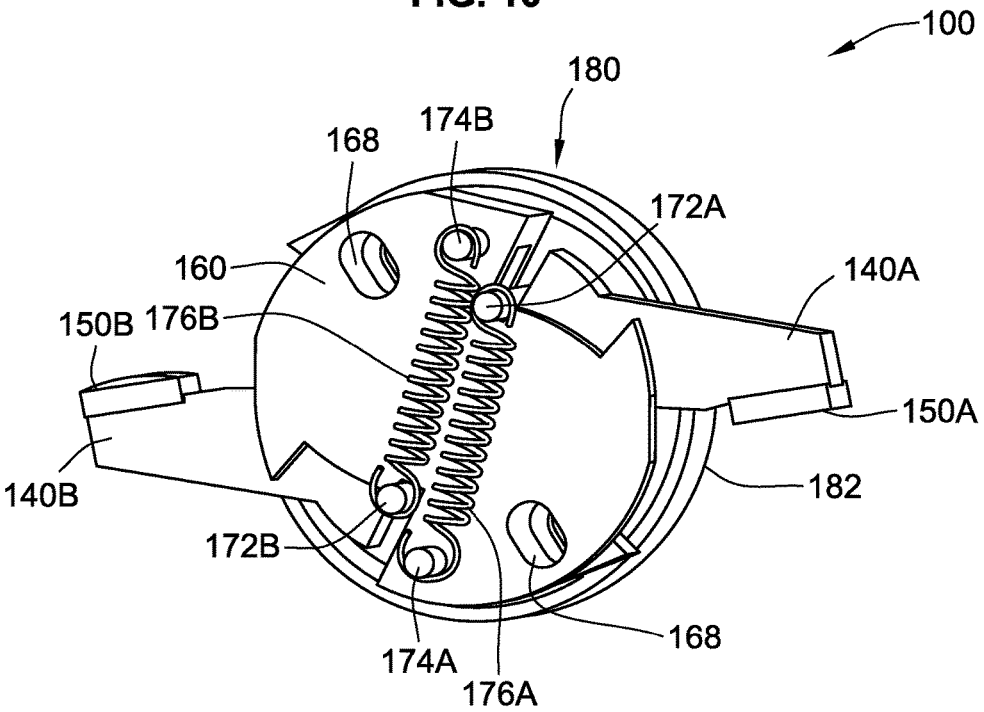
FIG. 11 illustrates an enlarged side view of the blade carrier assembly of FIG. 3 with one side of the cover removed to show the internal parts.

FIGS. 8 and 9 show the blade assembly 130 pivotally and rotatably mounted in the carrier 160 via the shaft 192. The carrier 160 has a cylindrical shape, and includes two opposing circular side plates 162A and 162B (collectively 162) with a curved cylindrical surface therebetween. The carrier 160 includes a cam surface 164A with a notch (or groove) 165A for the pivot pin 172A of the conductive blade 140A, and a cam surface 164B with a notch (or groove) 165B for the pivot pin 172B of the conductive blade 140B. The carrier 160 also includes a fixed pin opening 166A on each of the side plates 162 to receive the fixed pin 174A, and a fixed pin opening 166B on each of the side plates 162 to receive the fixed pin 174B. In addition, the carrier 160 includes drive pin openings 168 on each of the side plate 162 through which to receive a portion of one of the drive pins 18. The carrier 160 can be molded from a thermoset or a thermosetting material As shown in FIG. 9, the pivot pins 172A and 172B of respective conductive blades 140A and 140B are arranged on a first end of the cam surfaces 164A and 164B, respectively, such as in the open position of FIG. 1 (i.e., the normal open position or the tripped position) and the closed position of FIG. 2. An extension spring 176A is connected on each side of the carrier 160 between an end of the pivot pin 172A and an end of the fixed pin 174A. An extension spring 176B is connected on each side of the carrier 160 between an end of the pivot pin 172B and an end of the fixed pin 174B. Accordingly, the conductive blades 140A and 140B are able to pivot in relation to each other and have their own extension spring assembly (e.g., extension spring(s) and pins), so that the conductive blades 140A and 140B have their own independent over travel and contact force. FIG. 10 shows another view of the blade carrier assembly 100 of FIG. 9 with the cover 180 (only shown with one side of the cover). FIG. 11 shows an enlarged view of the blade carrier assembly 100 (with only one side of the cover 180 shown) of FIG. 3, in another open position, i.e., the blown open position. As shown in FIG. 11, the pivot pins 172A and 172B of respective conductive blades 140A and 140B are arranged or resting in respective notches 165A and 165B at a second end (opposite the first end) of the cam surfaces 164A and 164B, respectively.

An operational example of the interrupter module 10 of the circuit breaker 2 is discussed below with reference to FIGS. 1, 2 and 3. As shown in FIG. 1, the circuit breaker 2 is turned OFF with the blade carrier assembly 100 of the interrupter module 10 being in an open position, i.e., the normal open position or the tripped position. In this open position, the movable electrical contacts 150A and 150B of respective conductive blades 140A and 140B of the blade carrier assembly 100 are disengaged (e.g., disconnected) from corresponding stationary electrical contacts 20.

Figure 2:
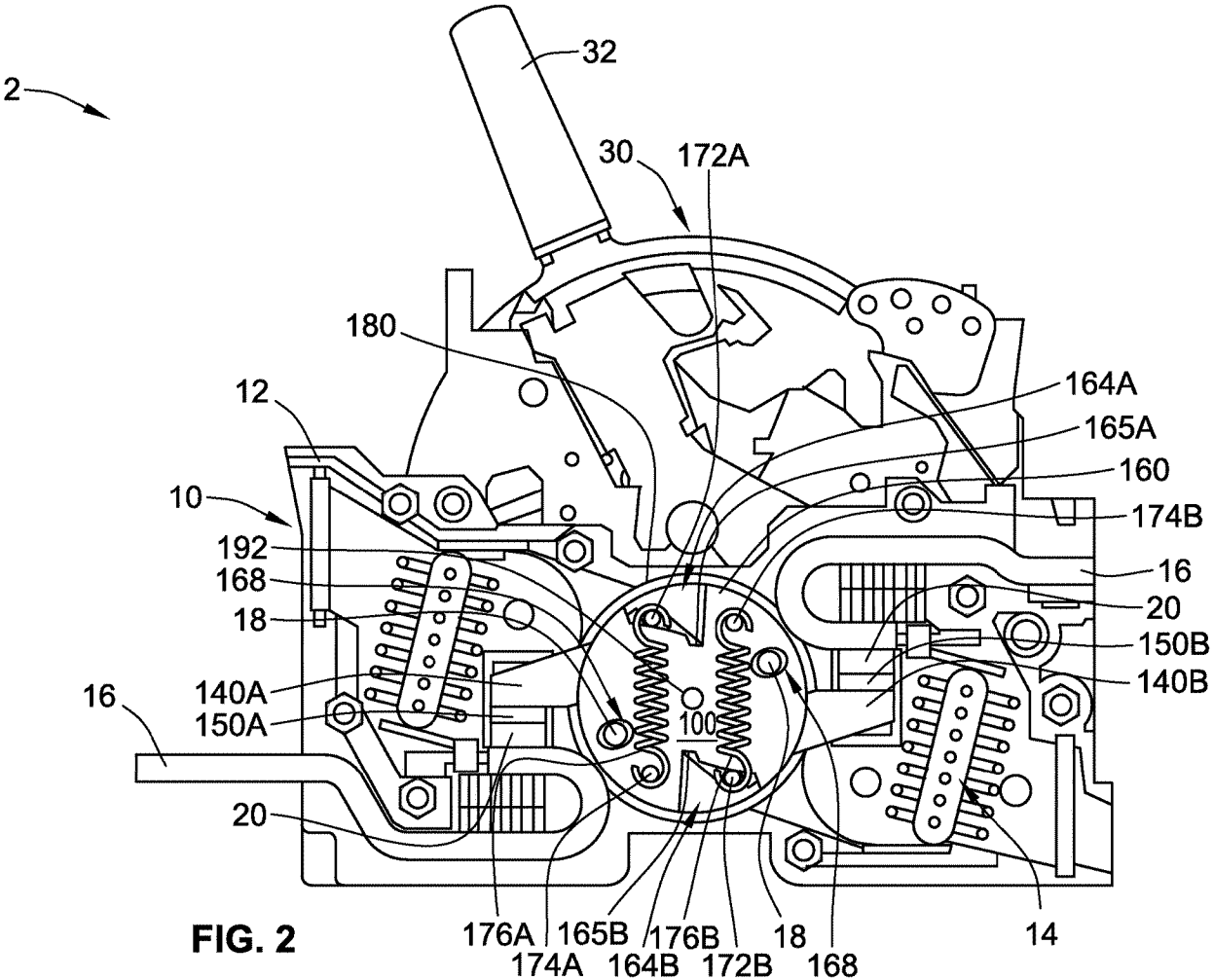
FIG. 2 illustrates a side view of the circuit breaker of FIG. 1 with one side removed to show the internal parts in a closed position or ON state.

A user can turn ON the circuit breaker 2 and its interrupter module 10 by moving the blade carrier assembly 100 to a closed position, as shown in FIG. 2, via the handle 32 of the operating mechanism 30. In the closed position, the movable electrical contacts 150A and 150B of respective conductive blades 140A and 140B are engaged (e.g., connected) to corresponding stationary electrical contacts 20 to allow operating current, for example, to pass downstream from a power line to one or more loads. As previously discussed, each of the conductive blades 140A and 140B has an independent over travel and contact force to maintain their movable electrical contacts 150A and 150B in contact or engagement with corresponding stationary contacts 20 in the closed position. For example, the conductive blades 140A and 140B are able to pivot in relation to each other and include their own extension spring assembly to provide each of the conductive blades 140A and 140B with an independent over travel and contact force. Thus, even where erosion has begun to deform one or more of the electrical contacts on one side of the interrupter module 10, the conductive blade on that side is able to pivot in relation to the other conductive blade, and with the force supplied from its own extension spring assembly, to engage its movable electrical contact to the stationary electrical contact with sufficient force to establish an electrical connection therebetween.

Figure 3:
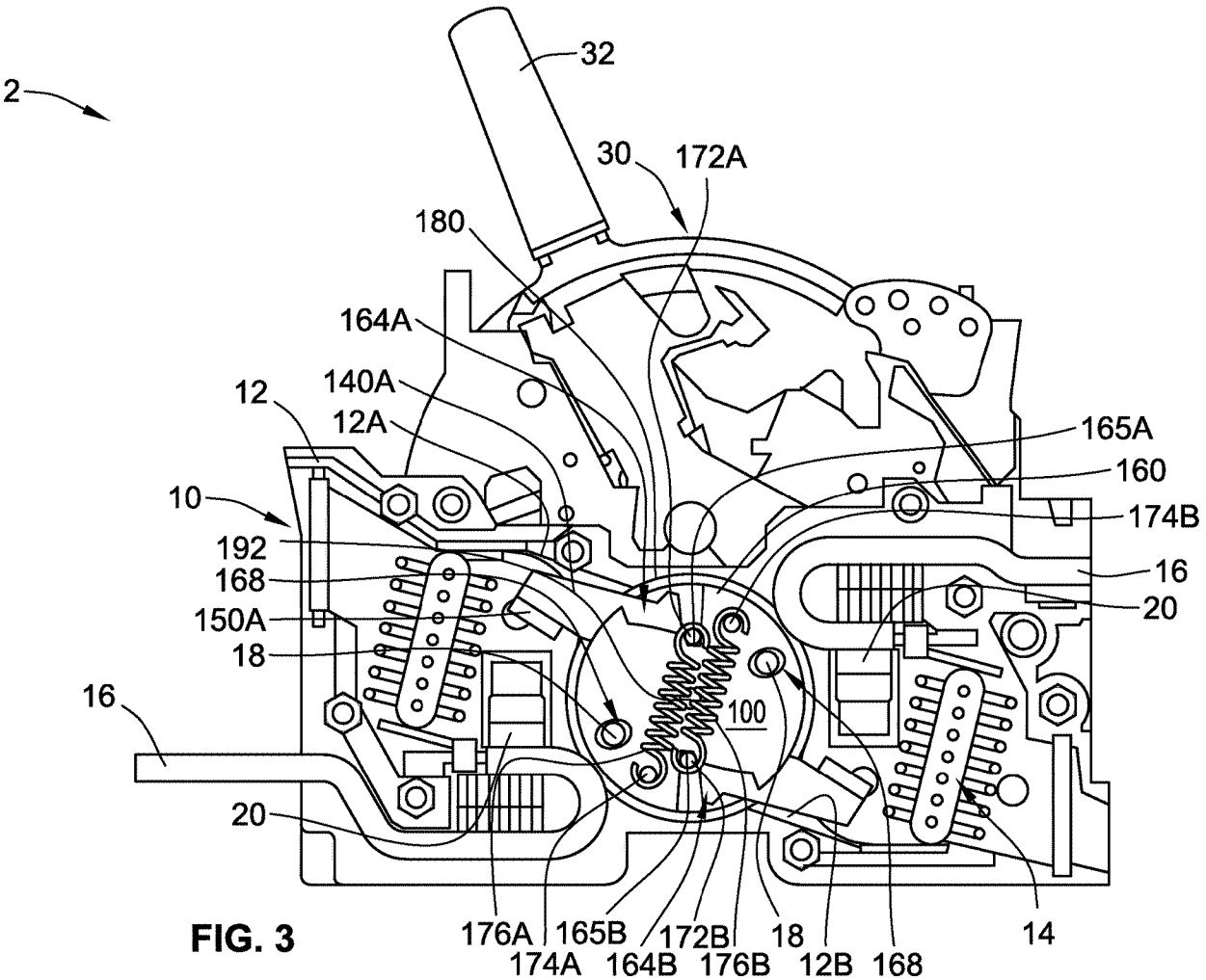
FIG. 3 illustrates a side view of the circuit breaker of FIG. 1 with one side removed to show the internal parts in an initial open position (i.e., a blown open position) before moving to the final open position (i.e., a normal open or tripped position) in FIG. 1.

When an electrical abnormality occurs, such as a short circuit or a current in excess of a fault current level or threshold (e.g., a fault current), the blade carrier assembly 100 moves to an initial open position, in this case, a blown open position, as shown in FIG. 3. For example, the movable electrical contacts 150A and 150B are magnetically disengaged from corresponding stationary electrical contacts 20 as a result of the magnetic field generated by the fault current. The conductive blades 140A and 140B pivot with respect to each other until the gap 148 (in FIG. 7) between their respective end portions 144A and 144B is closed, and the blades are unable to pivot further. The conductive blades 140A and 140B then rotate together in the carrier 160 to the initial open position, i.e., the blown open position, with the pivot pins 172A and 172B moving in a first direction from the first end of respective cam surfaces 164A and 164B of the carrier 160 toward and into the notches 165A and 165B, respectively, at a second end opposite the first end.

Simultaneously, the interrupter module 10 is tripped as a result of the fault current, and begins a trip operation to rotate the blade carrier assembly 100 from the blown open position in FIG. 3 to a final open position, i.e., the tripped position or the normal open position, such as shown in FIG. 1. For example, the blade carrier assembly 100 in FIG. 3 is driven by the tripping mechanism (not shown) via the drive pins 18 to rotate, such as in a clockwise direction. As the blade carrier assembly 100 continues to rotate, each of the conductive blades 140A and 140B (which are also rotatable in the carrier 160) contacts or abuts against respective interior surfaces 12A and 12B of the case 12 so that the pivot pins 172A and 172B move out of respective notches 165A and 165B at the second end of respective cam surfaces 164A and 164B. The pivot pins 172A and 172B then move in a second direction, opposite the first direction, along respective cam surfaces 164A and 164B back toward the first end of the cam surfaces 164A and 164B, where the blade carrier assembly 100 is arranged at the final open position as shown in FIG. 1. The user can thereafter turn ON the circuit breaker 2 and its interrupter 10, such as via the handle 32 of the operating mechanism 30, to the closed position as shown in FIG. 2.

The disclosed embodiments of the interrupter module, the blade carrier assembly and the blade assembly are provided as examples. Although the example of the interrupter module is discussed above as including blow-out contacts, such as employed in a current limiting circuit breaker, the blade carrier assembly and blade assembly disclosed herein may be incorporated into any type of circuit breaker or interrupter module that uses a rotatable blade or arm, or the like.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

The invention claimed is:

1. An interrupter module of a molded case circuit breaker, comprising:

two stationary electrical contacts; and a blade carrier assembly including:

a blade assembly having two conductive blades, each conductive blade including a movable electrical contact configured to engage a corresponding one of the two stationary contacts in a closed position and to disengage from the corresponding one of the two stationary contacts in an open position, each of the two conductive blades having an independent over travel and contact force to maintain contact between the movable electrical contacts and corresponding stationary electrical contacts in the closed position;

a rotatable carrier for the blade assembly, the two conductive blades mounted in the carrier to pivot in relation to one another; and an extension spring for each of the conductive blades, the extension spring of each of the conductive blades controlling the over travel and contact force of the conductive blade, wherein the blade carrier assembly further comprises:

a pivot pin for each conductive blade of the blade assembly, wherein the rotatable carrier further comprises a cam surface and a fixed pin for each conductive blade, the two conductive blades together further being rotatably mounted in the carrier such that the pivot pin of each conductive blade cams against a corresponding one of the cam surfaces of the carrier to control movement of the conductive blades between the closed position and the open position, the open position comprising a blown open position.

2. The interrupter module of claim 1, wherein each of the conductive blades includes a groove for retaining a pivot pin.

3. The interrupter module of claim 1, wherein each of the cam surfaces of the carrier includes a notch at one end to retain the pivot pin of a corresponding one of the conductive blades when the conductive blades are in the blown open position.

4. The interrupter module of claim 1, wherein the extension spring for each of the conductive blades comprises a pair of extension springs for each of the conductive blades.

5. The interrupter module of claim 1, wherein the open position includes one of a normal open position, a tripped position or a blown open position.

6. The interrupter module of claim 1, wherein the two conductive blades are pivotally connected together at an opposite end from the movable electrical contacts, a gap being provided in an area between the opposite ends of the conductive blades, when engaged, to allow one of the conductive blades to pivot in relation to the other of the conductive blades.

7. A rotatable blade carrier assembly for an interrupter module of a molded case circuit breaker, comprising:

a blade assembly having two conductive blades, each conductive blade including a movable electrical contact configured to engage a corresponding stationary electrical contact of an interrupter module in a closed position and to disengage from the corresponding stationary contacts in an open position, each of the two conductive blades having an independent over travel and contact force to maintain contact between the movable electrical contacts and corresponding stationary electrical contacts in the closed position;

a rotatable carrier for the blade assembly, the two conductive blades mounted in the carrier to pivot in relation to one another;

an extension spring for each of the conductive blades, the extension spring of each of the conductive blades controlling the over travel and contact force of the conductive blade; and a pivot pin for each conductive blade of the blade assembly, wherein the rotatable carrier further comprises a cam surface and a fixed pin for each conductive blade, the two conductive blades together further being rotatably mounted in the carrier such that the pivot pin of each conductive blade cams against a corresponding one of the cam surfaces of the carrier to control movement of the conductive blades between the closed position and the open position, the open position comprising a blown open position.

8. The rotatable blade carrier assembly of claim 7, wherein each of the conductive blades includes a groove for retaining a pivot pin.

9. The rotatable blade carrier assembly of claim 7, wherein each of the cam surfaces of the carrier includes a notch at one end to retain the pivot pin of a corresponding one of the conductive blades when the conductive blades are in the blown open position.

10. The rotatable blade carrier assembly of claim 7, wherein the two conductive blades are pivotally connected together at an opposite end from the movable electrical contacts, a gap being provided in an area between the opposite ends of the conductive blades, when engaged, to allow one of the conductive blades to pivot in relation to the other of the conductive blades.

* * * * *